US009700141B2

(12) United States Patent
Orlandoni

(10) Patent No.: US 9,700,141 B2
(45) Date of Patent: Jul. 11, 2017

(54) SUPPORT EQUIPMENT FOR SUPPORTING A PERSON AT REST HAVING A RIGID SUPPORTING ELEMENTS

(71) Applicant: Fabrizio Orlandoni, Fatta Todina (IT)

(72) Inventor: Fabrizio Orlandoni, Fatta Todina (IT)

(73) Assignee: EMU GROUP S.P.A., Marsciano (Perugia) (IT)

( * ) Notice: Subject to any disclaimer, the term of this patent is extended or adjusted under 35 U.S.C. 154(b) by 48 days.

(21) Appl. No.: 14/969,428

(22) Filed: Dec. 15, 2015

(65) Prior Publication Data

US 2016/0174718 A1 Jun. 23, 2016

(30) Foreign Application Priority Data

Dec. 19, 2014 (IT) ..... MI2014A2182

(51) Int. Cl.

| | |
|---|---|
| ***A47C 7/22*** | (2006.01) |
| ***A47C 5/06*** | (2006.01) |
| ***A47C 31/02*** | (2006.01) |
| ***A47C 3/00*** | (2006.01) |

(52) U.S. Cl.

CPC ..... *A47C 7/22* (2013.01); *A47C 3/00* (2013.01); *A47C 31/02* (2013.01); *Y10S 160/15* (2013.01); *Y10T 24/4727* (2015.01)

(58) Field of Classification Search

CPC ..... F16B 12/32; F16B 12/34; F16B 12/36; Y10S 160/15; Y10T 24/47; Y10T 24/4727; A47C 7/22; A47C 7/282; A47C 7/347; A47C 23/18; A47C 31/02; A47C 31/023; A47C 31/04; A47C 5/06

USPC ..... 24/265 C; 297/440.11, 452.63, 452.64, 297/452.59, 452.62; 160/371, 385, 392, 160/393, 395, 396, DIG. 15

See application file for complete search history.

(56) References Cited

U.S. PATENT DOCUMENTS

| | | | | |
|---|---|---|---|---|
| 984,939 A | | 2/1911 | Krite et al. | |
| 2,839,126 A | | 6/1958 | O'Neill et al. | |
| 2,896,696 A | * | 7/1959 | Molla | A47C 7/22 160/385 |
| 3,089,541 A | * | 5/1963 | Lockshin | A47C 31/04 160/383 |
| 3,272,497 A | | 9/1966 | Valdelievre et al. | |

(Continued)

OTHER PUBLICATIONS

Italian Patent Office, Written Opinion Relates to priority application IT MI2014A002182; explanation provided in transmittal letter.

*Primary Examiner* — Robert Canfield
(74) *Attorney, Agent, or Firm* — Themis Law

(57) ABSTRACT

Support equipment for supporting a person at rest includes a rigid supporting frame and at least one supporting element, to support the weight of the person resting on the support equipment. The frame has a tubular structure provided with a slot along at least part of its longitudinal extension, which has at least one portion with a width greater than the width of the remaining portions of slot, and the supporting element has the shape of a strip folded over itself at its ends, with the folded portions forming a loop inside which there is housed a pin having a central portion and two end portions of different thickness. The end portions of the pin have at least one dimension greater than the maximum dimension of the central portion.

10 Claims, 4 Drawing Sheets

(56) References Cited

U.S. PATENT DOCUMENTS 4,848,843 A * 7/1989 Gibbs ..... A47C 11/005 248/188
4,910,817 A * 3/1990 Kita ..... B29C 53/36 156/163
5,445,254 A * 8/1995 Charles ..... B60N 2/7011 192/114 R
5,507,563 A * 4/1996 Arthur, Jr. ..... A47C 4/03 297/440.23
5,762,403 A * 6/1998 Robinson ..... A47C 5/06 297/440.11
5,836,655 A * 11/1998 Laufer ..... A47C 31/04 160/392
5,911,478 A * 6/1999 Goodman ..... A47C 7/22 297/440.11
6,092,762 A * 7/2000 Aaron ..... G11B 23/26 226/92
6,293,624 B1 9/2001 Gaylord et al.
6,388,838 B1 * 5/2002 Kaneda ..... G11B 23/107 242/332.4
6,560,827 B1 * 5/2003 Gross ..... A47C 17/84 24/265 C
6,779,849 B1 * 8/2004 Harper ..... A47C 5/06 297/440.11
7,568,768 B1 * 8/2009 Tsai ..... A47C 7/28 24/265 C
7,740,320 B2 * 6/2010 Chiang ..... A47C 4/02 297/440.15
8,317,270 B2 * 11/2012 Tseng ..... A47C 5/06 297/440.11
8,403,421 B2 * 3/2013 Wang ..... A47C 5/06 297/440.11
8,523,283 B2 * 9/2013 Lee ..... A47C 5/06 297/284.2
8,919,884 B2 * 12/2014 Lee ..... A47C 5/06 297/440.11
9,560,916 B1 * 2/2017 Bullard ..... A47C 7/22

* cited by examiner

SUPPORT EQUIPMENT FOR SUPPORTING A PERSON AT REST HAVING A RIGID SUPPORTING ELEMENTS

FIELD OF THE INVENTION

The invention relates to the furniture sector, in particular but not exclusively to furniture used mainly as outdoor equipment, characterized by simple structures, made with materials having prolonged resistance to weathering and ageing. In particular, the invention relates to chairs, armchairs and sun loungers, which facilitate a short or longer period of rest for the user. More specifically, the invention relates to equipment for supporting a person at rest, comprising a rigid supporting frame, variously shaped, and a plurality of supporting elements, to support the weight of the person resting on said elements, advantageously secured to said frame.

In the present description, the term support equipment is meant to indicate all those items of furniture, or parts of items of furniture, such as chairs, armchairs, their seats, sun loungers, springs for sun loungers, backrests, headrests and all those parts of items of furniture that support the weight of the person sitting, lying or resting thereon, making their use comfortable.

BACKGROUND OF THE INVENTION

A quick and inexpensive way of making this type of furniture consists in constraining to a supporting structure one or more supporting elements, with which the portion of structure intended to support the weight of the person, for example the seat or backrest for chairs and armchairs or the springs for a bed, is completed.

However, a critical feature of these items of furniture lies not only in the preparation of the supporting elements, but also when it becomes necessary to replace elements that have broken or deteriorated through time and with use, i.e. during the steps of assembling and disassembling these elements on and from the supporting structure. In fact, the relevant operation is technically difficult and economically costly, so that often it is not worthwhile, even if the supporting structure, equipped with new elements, could still be used for a long time.

SUMMARY OF THE INVENTION

The Applicant has found that the above described problems can be overcome with a new type of equipment, provided with particular means for securing the supporting elements to the structure, that make the assembly and disassembly operations of said elements, on and from the structure, easy, fast and inexpensive and that provide a totally reliably product.

Therefore, the object of the invention is support equipment for supporting a person at rest, which comprises a new system for securing the supporting element to the aforesaid frame.

In particular, the invention relates to support equipment for supporting a person at rest, said support equipment comprising a rigid supporting frame and at least one supporting element, for supporting the weight of the person resting on said element, secured to said frame, wherein said frame comprises a tubular structure that includes tube having a slot along at least part of its longitudinal extension, said slot having at least one portion with a width greater than the width of the remaining portions of slot, said supporting element having the shape of a strip folded over itself at least at one end, said folded portions forming a loop inside which there is housed a pin having the ends with at least one dimension greater than the maximum dimension of the central portion of said pin.

Additional features and advantages of the invention will be more apparent from the detailed description of a particular, but not exclusive, embodiment of the equipment, provided purely to facilitate the description and understanding of the invention.

BRIEF DESCRIPTION OF THE DRAWINGS

This description will be set forth below with reference to said embodiment, conveniently represented by a chair, of which there are provided, purely for non-limiting explanatory purposes, the accompanying drawings, wherein.

DETAILED DESCRIPTION OF EMBODIMENTS OF THE INVENTION

Figure 1:
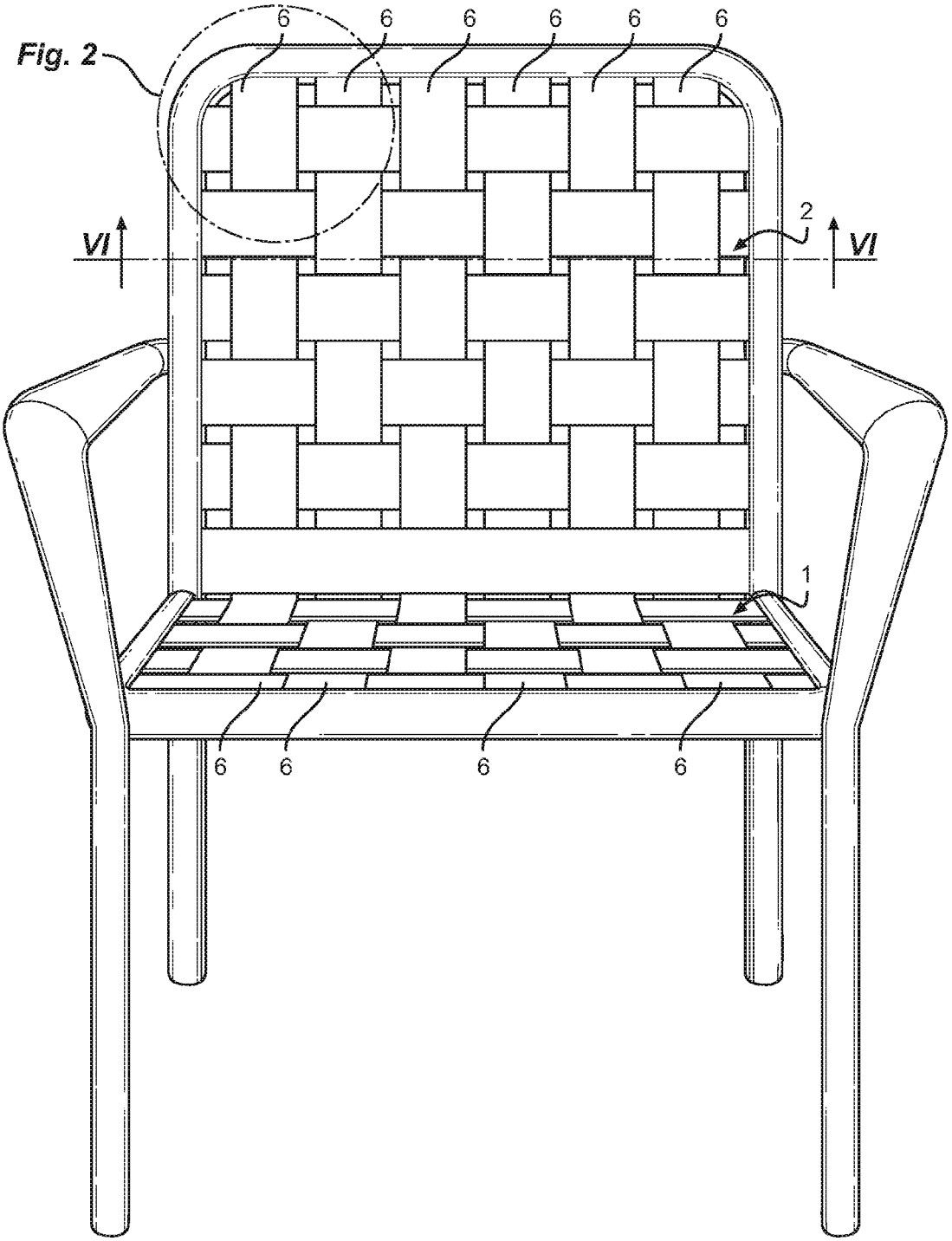
FIG. 1 shows, in a front view, the assembly drawing of said chair.
Figure 3:
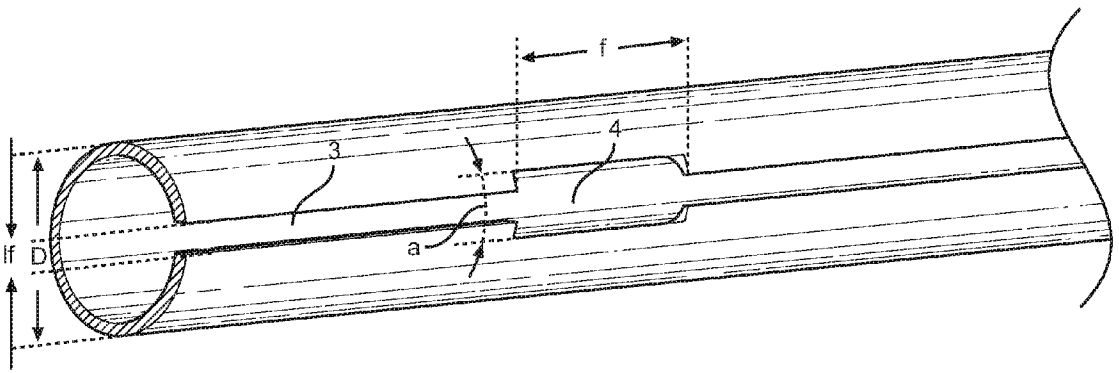
FIG. 3 shows a section of the tube forming the frame of said equipment.
Figure 4:
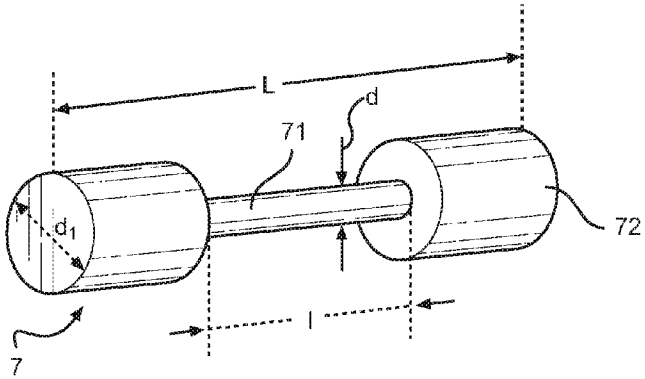
FIG. 4 shows the connection element between said frame and the elements of said supporting structure.
Figure 6:
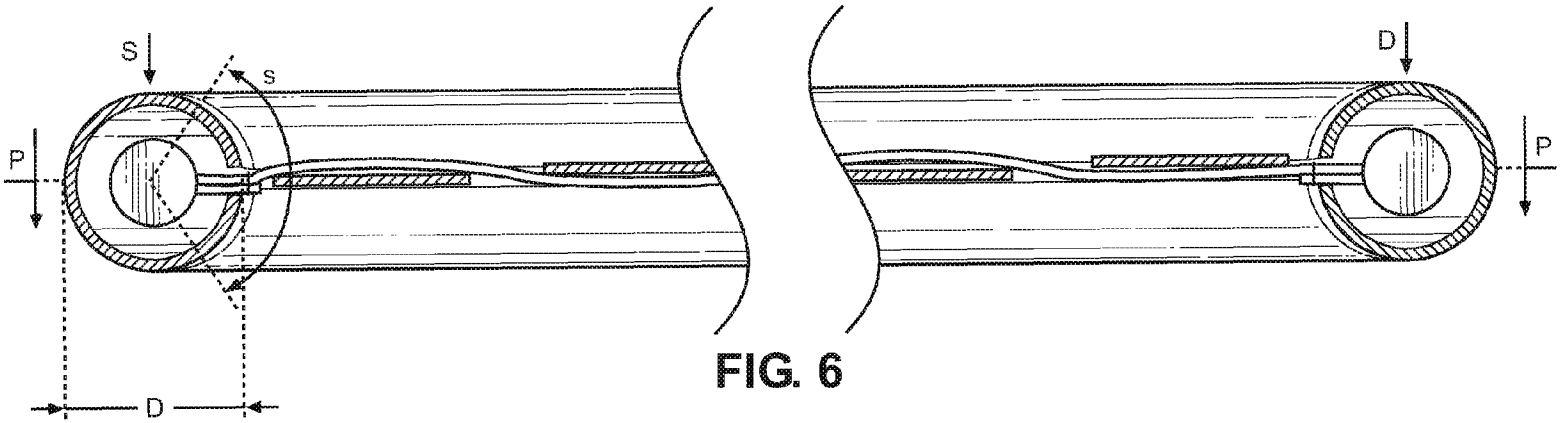
FIG. 6 shows, in a cross section according to plane VI-VI of FIG. 1, the type of assembly between the tube and the supporting structure.

FIG. 1 shows an assembly of metal elements, variously shaped and welded to one another so as to define four supporting legs that sustain a seat 1, provided laterally with armrests, and a backrest 2, in a rear position with respect to the position in which a person sits, to support the back of said person. In the remainder of the present description, for convenience, seat and backrest will be indicated as the frame of the equipment, ignoring the presence of other elements such as the above mentioned legs and armrests. The metal elements that delimit the frame, i.e. seat and backrest of the chair, have (FIG. 3) a tubular shape, preferably cylindrical (i.e. with circular cross section), and have a slot 3 that runs along a generatrix of the tubular shape. Preferably, the frame consists of a single tubular element structured to define substantially flat figures, bent at the corners according to a particular radius of curvature that will be described hereunder. The slot can be machined in any point of the perimeter of the tubular section, for example on the same plane "p" on which the frame lies (FIG. 6) so that the lengths of a slot belonging to two opposite tubular portions (right D and left S for the observer—FIG. 6) are facing each other.

In at least one point of said slot, or of each portion of slot not connected with the adjacent portions, the slot is enlarged into a window 4 of considerably larger amplitude than the width of the slot.

Figure 7:
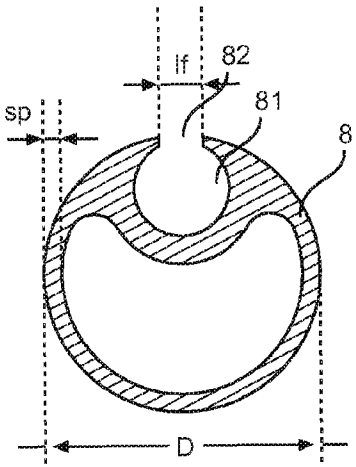
FIG. 7 shows a cross section of a preferred embodiment of the tube according to the invention.

In a preferred embodiment of the invention (FIG. 7) the tubular element that defines the frame of the equipment consists of a drawn aluminum tube 8, drawn along a generatrix so as to have a groove 81, with circular cross section, open towards the outside through a mouth 82 equivalent to the slot 3 and for which the same features that were provided above for said slot apply.

According to the invention, the supporting structure comprises at least one strip 6, but preferably a plurality of strips 6 made of a suitable material, the ends of which are secured in said slots in axially opposite positions.

These strips can be made of any suitable material, such as rubber or leather straps, but are preferably elastic strips made by weaving polyethylene fibers and synthetic rubber yarns.

Figure 2:
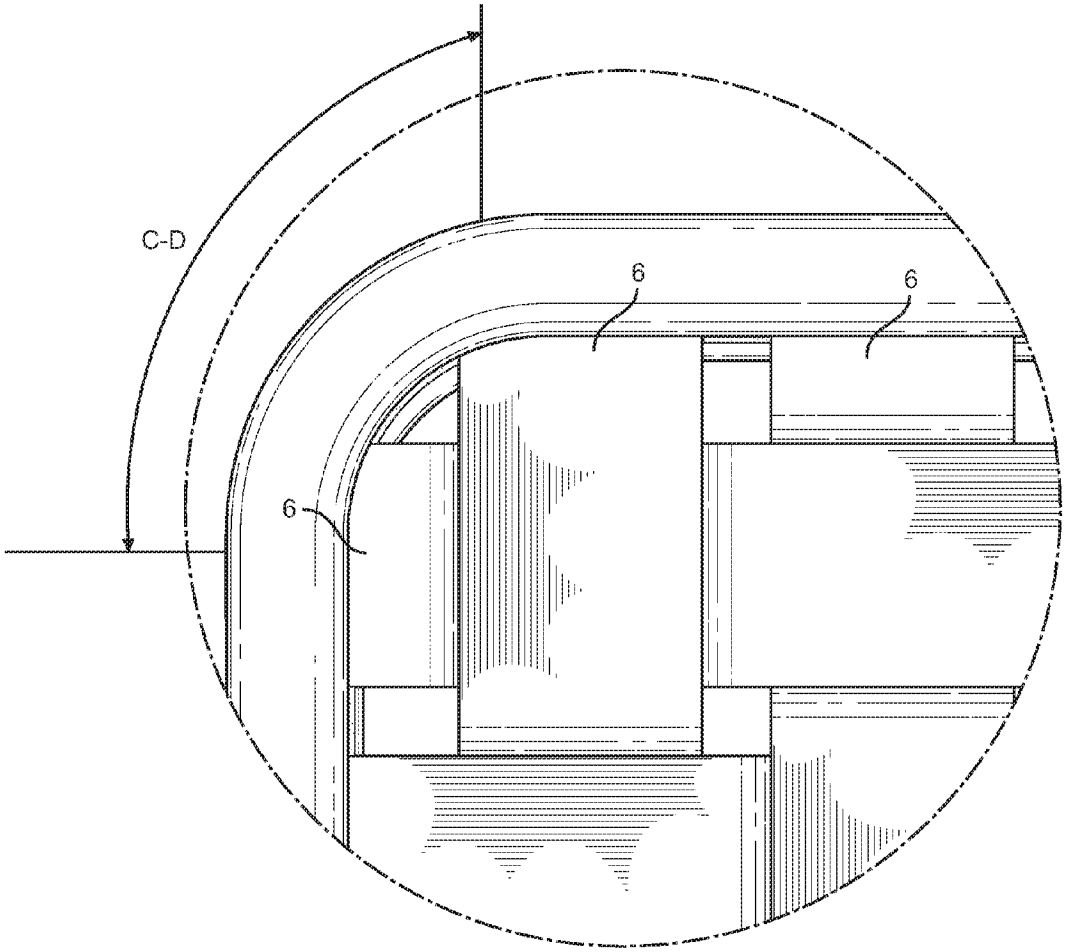
FIG. 2 shows a detail of the backrest of said chair to highlight a preferred embodiment of supporting elements according to the invention.

Preferably, the strips secured in opposite portions of tube are alternately crossed over with strips secured to adjacent portions of tube, as shown in FIGS. 1 and 2.

Figure 5:
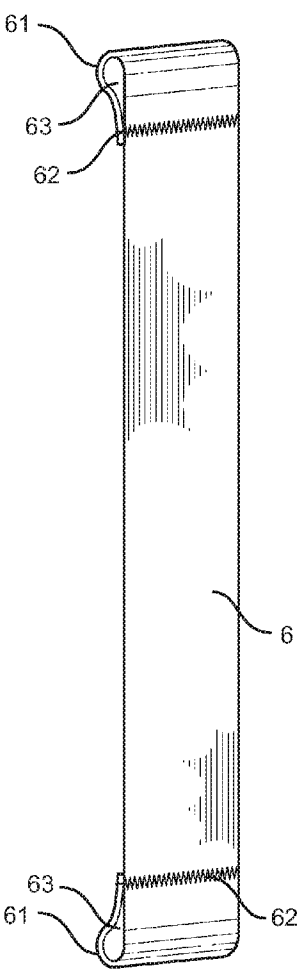
FIG. 5 shows a perspective view of one of the elements forming said supporting structure.

Securing as mentioned above is performed as follows. At least one end flap 61, but preferably both end flaps, of each strip are folded over themselves (FIG. 5) and assembled to the central portion of the strip in any appropriate way, for example by stitching 62, or glued by thermal bonding along a band with a width comprised between 20 mm and 100 mm, so as to form an eyelet 63.

There is inserted in the aforesaid eyelet a pin 7, preferably made of plastic material, having a central portion 71, with a width substantially the same as the width of the strip, and two expansions 72 at opposed ends, having at least a transverse dimension of greater amplitude than the transverse dimension present in the central portion of the pin, so as to block longitudinal sliding of the strip along the pin.

The method of constraining the strips to the frame is as follows. After having inserted a pin into an eyelet of the strip, an expansion of said pin is inserted in the tube through the window 4. The pin is made to slide longitudinally inside the tube, insuring that the strip is housed inside the slot, so as also to insert the expansion at the opposite end of the pin inside the tube. This way, the weight of the person resting or sitting or lying on the equipment can only put the strip under tensile stress but cannot cause its removal from the tube as the expansions of the pin, through interference, retain the loop of the strip wrapped around the pin inside the tube. Preferably, a large number of strips are used, each wrapped at both ends around a corresponding pin.

Assembly of the strips on the equipment is performed by inserting the various pins in succession through the window 4 inside the tube, making them slide along said tube to make room for the subsequent insertion. It can be immediately observed how the length of the central portion 71 of the pin controls the width of the strip 6; the length of the expansions 72 controls the distance between adjacent strips; and the total length of the pin 7, together with any flexibility of the material of which it is formed, controls the radius of curvature of the arc C-D (FIG. 2) of the angular portions of the frame. That radius of curvature is not relevant when the frame is formed with rectilinear sections of tube, constrained to one another at the respective ends.

It must be noted that the length of the lateral expansions of the pin is not necessarily identical for both expansions. For example, at least one pin can have a lateral expansion of a different length from that of the expansion at the opposite end.

In a prototype produced by the Applicant, the frame is constructed with extruded aluminum tubular elements (FIG. 7) with a circular section having an outer diameter "D" of 25 mm and a thickness "sp" of substantially 2 mm. Preferably, the value "D" is comprised between 18 mm and 40 mm. The mouth 82 (slot 3) has a width "lf" of 4 mm and preferably comprised between 3 and 12 mm. The window 4 has a length "f" of 20 mm and preferably comprised between 10 mm and 40 and a width "a" of 7 mm and preferably comprised between 5 mm and 15 mm. With reference to the plane "p" on which the frame lies, the tube can be arranged so that the mouth 82 (the slot 3) is inside an arc "s" of 270° in both directions with respect to the aforesaid plane "p". The lateral expansions 72 of the roller 7, preferably cylindrical, have a diameter "d1" of 5 mm and preferably comprised between 4 mm and 13 mm, while the central portion 71 has a diameter "d" of 3 mm and preferably comprised between 2 mm and 11 mm. The total length "L" of the roller 7 is of 60.5 mm and preferably comprised between 30.5 mm and 110.5 mm, while the length "l" of the central portion 71 is of 48.5 mm and preferably comprised between 18.5 mm and 98.5 mm, equal to or, preferably, slightly greater than that of the corresponding strip 6, the nominal width of which is 50 mm and preferably comprised between 20 mm and 100 mm.

The material of the frame is preferable selected in the group comprising aluminum, that of the pin is preferably selected in the group comprising PE, HDPE, nylon, ABS, PP (polymers in general) while the textile material of the elastic strips is preferably selected in the group comprising suitable treated natural fibers, such as cotton, flax, hemp, etc, or synthetic fibers, such as polyethylene, acrylic fiber or textilene.

The invention solves the stated problem and provides various advantages. Among other things, the production of the supporting strips and of the securing pins is advantageously inexpensive and, at the same time, assembly of the strips on the supporting structure is also fast, inexpensive and easy to perform, as is disassembly of the strips that are no longer usable or of the related securing pins.

In the present description, all the possible structural and dimensional alternatives to the embodiments of the invention specifically described have not been illustrated, because it seemed unnecessary to expand the construction details of the system of the invention as, after the instructions provided herein, no person skilled in the art will have difficulty in designing, choosing the appropriate materials and sizes, and the most advantageous technical solution.

These variants, however, all fall within the scope of protection of the present patent, as these alternative embodiments are easily attainable from the present description of aspects of the invention with the results that the invention aims to achieve.

The invention claimed is:

1. Support equipment for supporting a person at rest, said support equipment comprising: a rigid supporting frame; and at least one supporting element, adapted to support a weight of a person resting on said support element, said at least one supporting element being secured to said frame, wherein said frame comprises a tubular structure that includes a tubular element, said tubular element having a slot along at least part of its longitudinal extension, said slot having at least one portion with a width greater than a width of remaining portions of the slot, and wherein said at least one supporting element is shaped as a strip folded over itself at least at one end to provide one or more folded portions, said folded portions each forming a loop inside which there is housed a pin having ends with at least a transverse dimension greater than a maximum transverse dimension of a central portion of said pin, said pin engaging said slot.

2. The support equipment according to claim 1, wherein tubular element of said frame has a circular cross section that provides said slot.

3. The support equipment according to claim 2, wherein said tubular element is a drawn aluminum tube, having a groove with a circular cross section.

4. The support equipment according to claim 1, wherein said frame comprises a single tubular element structured to define substantially flat figures.

5. The support equipment according to claim 1, wherein said at least one supporting element comprises a plurality of textile strips.

6. The support equipment according to claim 5, wherein at least one end flap of each strip is folded over itself to form the loop, the loop providing an eyelet.

7. The support equipment according to claim 6, wherein said at least one end flap is coupled to a central portion of its respective strip by stitching.

8. The support equipment according to claim 6, wherein said at least one end flap is assembled onto a central portion of its respective strip by thermal bonding along a band with a width comprised between 20 mm and 80 mm.

9. The support equipment according to claim 5, wherein said central portion of said pin has a width that is substantially same as a width of a corresponding textile strip.

10. The support equipment according to claim 5, wherein the textile strips are secured to opposite portions of the tubular element and are alternately crossed over with strips secured to adjacent portions of the tubular element.

* * * * *